US010943719B2

(12) United States Patent
Asai et al.

(10) Patent No.: US 10,943,719 B2
(45) Date of Patent: Mar. 9, 2021

(54) COIL COMPONENT

(71) Applicant: TDK CORPORATION, Tokyo (JP)

(72) Inventors: Miyuki Asai, Tokyo (JP); Hokuto Eda, Tokyo (JP); Masazumi Arata, Tokyo (JP); Hitoshi Ohkubo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/877,944

(22) Filed: May 19, 2020

(65) Prior Publication Data

US 2020/0373050 A1 Nov. 26, 2020

(30) Foreign Application Priority Data

May 21, 2019 (JP) ..... JP2019-095127

(51) Int. Cl.
*H01F 5/06* (2006.01)
*H01F 17/00* (2006.01)

(52) U.S. Cl.
CPC ..... *H01F 5/06* (2013.01); *H01F 17/0013* (2013.01)

(58) Field of Classification Search
CPC ..... H01F 5/06; H01F 17/0013
USPC ..... 174/110 R
See application file for complete search history.

(56) References Cited

U.S. PATENT DOCUMENTS 10,504,644 B2 * 12/2019 Lee ..... H01F 27/02
2013/0341758 A1 * 12/2013 Lee ..... H01F 27/255 257/531
2015/0035634 A1 * 2/2015 Nakamura ..... H01F 41/046 336/170
2018/0122546 A1 * 5/2018 Lee ..... H01F 27/29
2018/0261377 A1 9/2018 Kim
2019/0311831 A1 * 10/2019 Yeo ..... H01F 41/042
2019/0333687 A1 * 10/2019 Yang ..... H01F 41/042
2020/0066436 A1 * 2/2020 Kim ..... H01F 41/046
2020/0075228 A1 * 3/2020 Jeong ..... H01F 17/0013
2020/0098509 A1 * 3/2020 Kim ..... H01F 27/292

FOREIGN PATENT DOCUMENTS

JP 2018-148200 A 9/2018

* cited by examiner

*Primary Examiner* — Timothy J Thompson
*Assistant Examiner* — Michael F McAllister
(74) *Attorney, Agent, or Firm* — Oliff PLC

(57) ABSTRACT

In a coil component, an insulation layer covers an upper surface of a conductor pattern. Accordingly, insulating properties between the conductor pattern and a magnetic body are enhanced, and insulating properties between the conductor patterns are enhanced. In addition, in the coil component, the magnetic body enters a space between resin walls such that the insulation layer is covered. Therefore, a volume of the magnetic body above the conductor pattern is increased, and high coil characteristics are realized.

6 Claims, 8 Drawing Sheets

COIL COMPONENT

CROSS-REFERENCE TO RELATED APPLICATIONS

This application is based upon and claims the benefit of priority from Japanese Patent Application No. 2019-95127, filed on 21 May 2019, the entire contents of which are incorporated herein by reference.

TECHNICAL FIELD

The present disclosure relates to a coil component.

BACKGROUND

Regarding a coil component in the related art, for example, Japanese Unexamined Patent Publication No. 2018-148200 discloses a coil component which includes a coil pattern that is provided on an insulation substrate, a resin wall that defines a region for forming a flat coil pattern on the insulation substrate, and a magnetic body that integrally covers the coil pattern and the resin wall; and in which an insulation layer is interposed between a coil and the magnetic body.

SUMMARY

In a coil component according to the technology in the related art described above, a creepage distance between coil patterns adjacent to each other with a resin wall therebetween is not sufficient, so that a short circuit between the coil patterns may occur. The inventors have newly found a technology in which coil characteristics can be improved by increasing a volume of a magnetic body above a coil pattern while insulating properties between the coil patterns are enhanced.

According to the present disclosure, a coil component having improved insulating properties between coil patterns and improved coil characteristics is provided.

According to an aspect of the present disclosure, there is provided a coil component including an insulation substrate; a coil having a flat coil pattern formed on at least one surface of the insulation substrate; a resin wall provided on the insulation substrate, defining a region for forming the flat coil pattern, and having a height on the basis of the insulation substrate higher than a height of the flat coil pattern; an insulation layer covering an outer surface of the flat coil pattern between the resin walls; and a magnetic body integrally covering the insulation substrate and the coil, entering a space between the resin walls, and covering the insulation layer.

In the foregoing coil component, insulating properties between the coil patterns are improved due to the insulation layer covering the outer surface of the flat coil pattern. Since the magnetic body enters a space between the resin walls such that the insulation layer is covered, a volume of the magnetic body is effectively increased, and coil characteristics are improved.

In the coil component according to the aspect of the present disclosure, the insulation layer may have a thinnest portion, a thickness in the thinnest portion in a thickness direction of the insulation substrate is the thinnest, and the thinnest portion may be thinner than a width of an upper end of the resin wall.

In the coil component according to the aspect of the present disclosure, an upper surface of the insulation layer may be curved in a concave shape, or an upper surface of the insulation layer may be curved in a convex shape.

DETAILED DESCRIPTION

Figure 1:
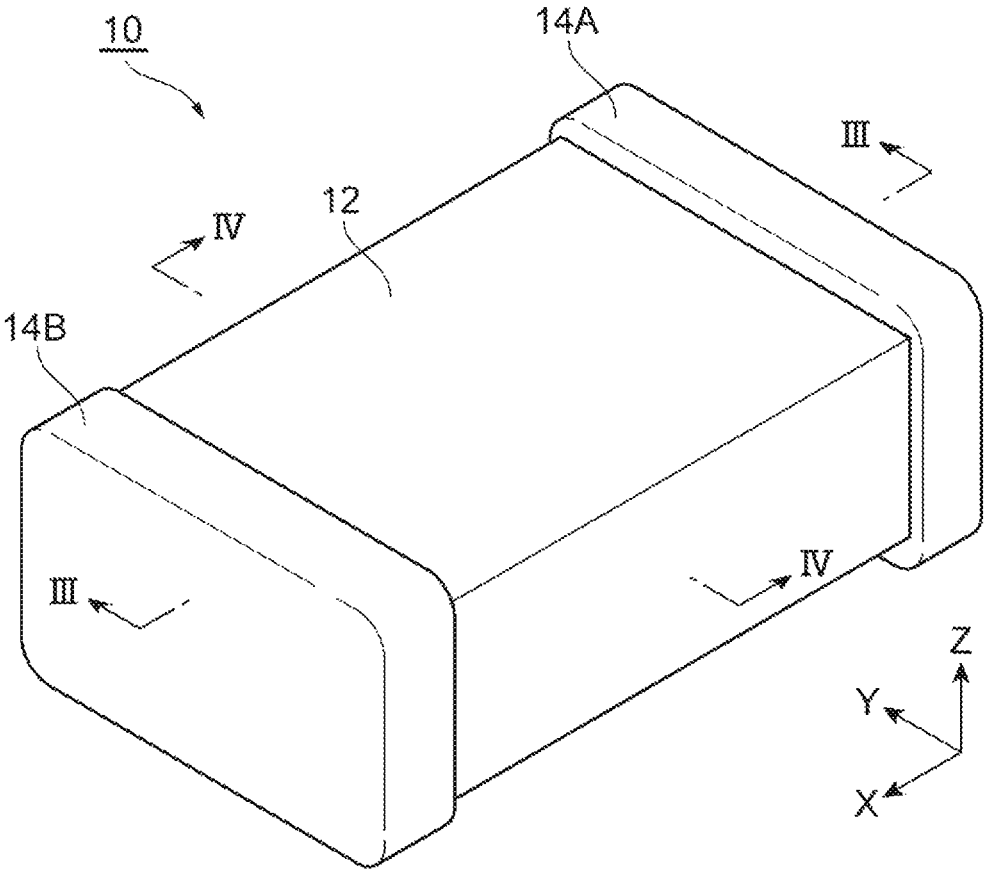
FIG. 1 is a schematic perspective view of a coil component according to an embodiment.
Figure 2:
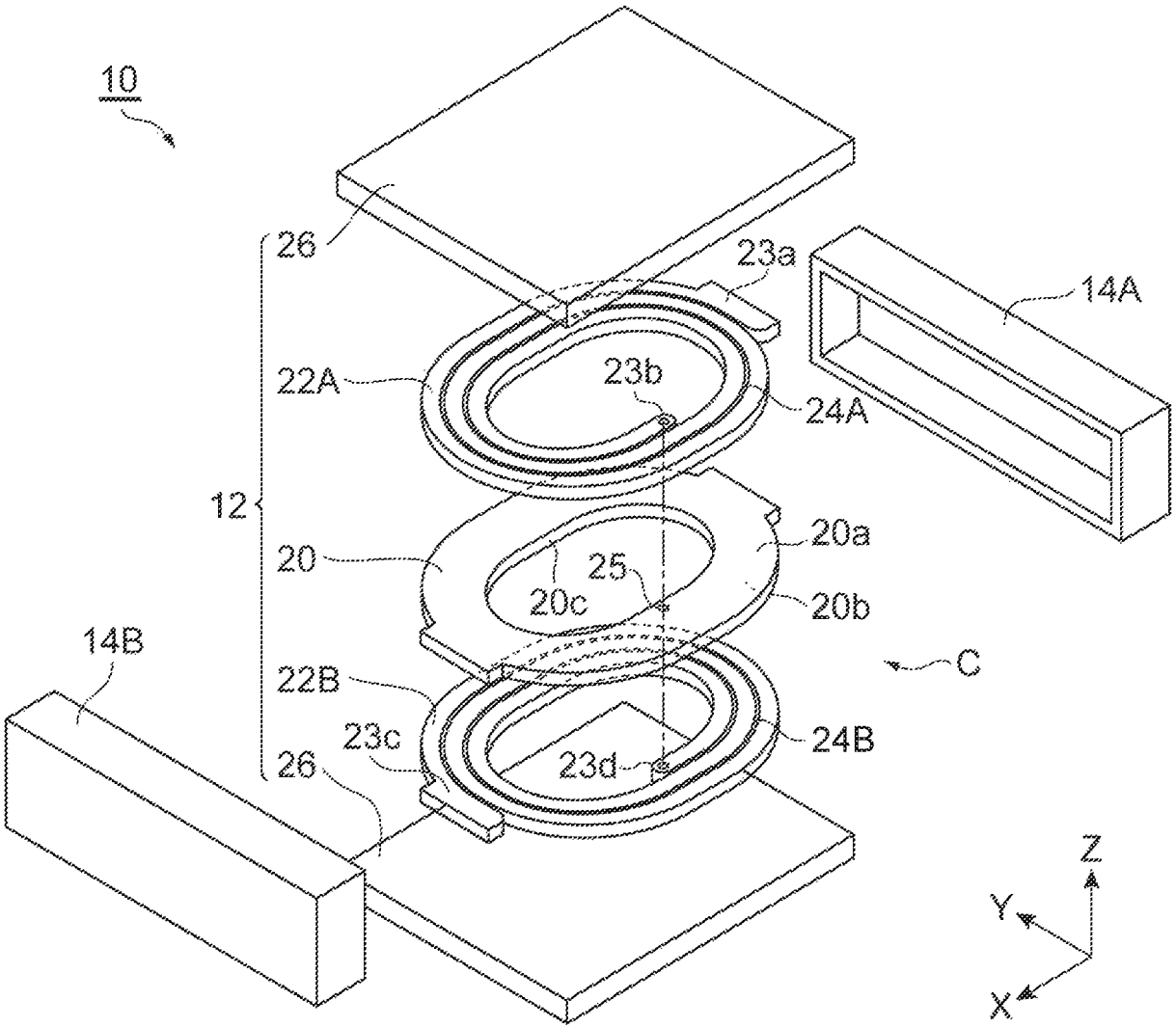
FIG. 2 is an exploded view of the coil component shown in FIG. 1.

Hereinafter, with reference to the accompanying drawings, an embodiment of the present disclosure will be described in detail. In the description, the same reference signs are used for the same elements or elements having the same function, and duplicate description will be omitted.

With reference to FIGS. 1 to 4, a structure of a coil component according to the embodiment will be described. For the sake of convenience of description, an XYZ coordinate system is set as shown in the diagrams. That is, a thickness direction of the coil component is set to a Z direction, a direction in which external terminal electrodes face each other is set to an X direction, and a direction orthogonal to the Z direction and the X direction is set to a Y direction.

A coil component 10 is a flat coil element and is constituted of a main body portion 12 which exhibits a rectangular parallelepiped shape, and a pair of external terminal electrodes 14A and 14B which are provided on an outer surface of the main body portion 12. A pair of external terminal electrodes 14A and 14B are provided such that the whole surfaces of a pair of end surfaces 12*a* and 12*b* facing each other in the X direction are covered. As an example, the coil component 10 is designed to have dimensions of a long side of 2.5 mm, a short side of 2.0 mm, and a height within a range of 0.8 to 1.0 mm.

The main body portion 12 is configured to include an insulation substrate 20, a coil C provided in the insulation substrate 20, and a magnetic body 26.

The insulation substrate 20 is a plate-shaped member constituted of a non-magnetic insulating material and has a substantially elliptical ring shape when viewed in the thickness direction thereof. An elliptical penetration hole 20*c* is provided in a central part of the insulation substrate 20. A substrate in which a glass cloth is impregnated with an epoxy-based resin and which has a plate thickness within a range of 10 μm to 60 μm can be used as the insulation substrate 20. Not only an epoxy-based resin but also a BT resin, polyimide, aramid, or the like can be used. Regarding a material for the insulation substrate 20, ceramic or glass can also be used. Regarding a material for the insulation substrate 20, a material for mass-produced printed boards may be adopted, or a resin material used for BT printed boards, FR4 printed boards, or FR5 printed boards may be adopted.

The coil C has a first coil portion 22A which is subjected to insulation coating with a first conductor pattern 23A for a flat air-core coil provided on one surface 20*a* (upper surface in FIG. 2) of the insulation substrate 20, a second coil portion 22B which is subjected to insulation coating with a second conductor pattern 23B for a flat air-core coil provided on the other surface 20*b* (lower surface in FIG. 2) of the insulation substrate 20, and a through-hole conductor 25 which connects the first conductor pattern 23A and the second conductor pattern 23B to each other. That is, the coil C includes two conductor patterns 23 (flat coil patterns), that is, the first conductor pattern 23A and the second conductor pattern 23B.

The first conductor pattern 23A is a flat spiral pattern serving as a flat air-core coil and is formed through plating using a conductor material such as Cu. The first conductor pattern 23A is formed to be wound around the penetration hole 20*c* of the insulation substrate 20. More specifically, the first conductor pattern 23A is wound in three clockwise turns toward the outward side when viewed in the upward direction (Z direction). The height of the first conductor pattern 23A (length in the thickness direction of the insulation substrate 20) is the same throughout the entire length.

An end portion 22*a* of the first conductor pattern 23A on the outward side is exposed on the end surface 12*a* of the main body portion 12 and is connected to the external terminal electrode 14A covering the end surface 12*a*. An end portion 23*b* of the first conductor pattern 23A on the inward side is connected to the through-hole conductor 25.

Similar to the first conductor pattern 23A, the second conductor pattern 23B is also a flat spiral pattern serving as a flat air-core coil and is formed through plating using a conductor material such as Cu. The second conductor pattern 23B is also formed to be wound around the penetration hole 20*c* of the insulation substrate 20. More specifically, the second conductor pattern 23B is wound in three counter-clockwise turns toward the outward side when viewed in the upward direction (Z direction). That is, the second conductor pattern 23B is wound in a direction opposite to that of the first conductor pattern 23A when viewed in the upward direction. The height of the second conductor pattern 23B is the same throughout the entire length and can be designed to have the same height as that of the first conductor pattern 23A.

An end portion 23*c* of the second conductor pattern 23B on the outward side is exposed on the end surface 12*b* of the main body portion 12 and is connected to the external terminal electrode 14B covering the end surface 12*b*. An end portion 23*d* of the second conductor pattern 23B on the inward side is positionally aligned with the end portion 23*b* of the first conductor pattern 23A on the inward side in the thickness direction of the insulation substrate 20 and is connected to the through-hole conductor 25.

The through-hole conductor 25 is provided such that it penetrates an edge region of the penetration hole 20*c* of the insulation substrate 20 and connects the end portion 23*b* of the first conductor pattern 23A and the end portion 23*d* of the second conductor pattern 23B to each other. The through-hole conductor 25 can be constituted of a hole provided in the insulation substrate 20 and a conductive material (for example, a metal material such as Cu) filling the hole. The through-hole conductor 25 has a substantially columnar or a substantially prismatic external shape extending in the thickness direction of the insulation substrate 20.

Figure 3:
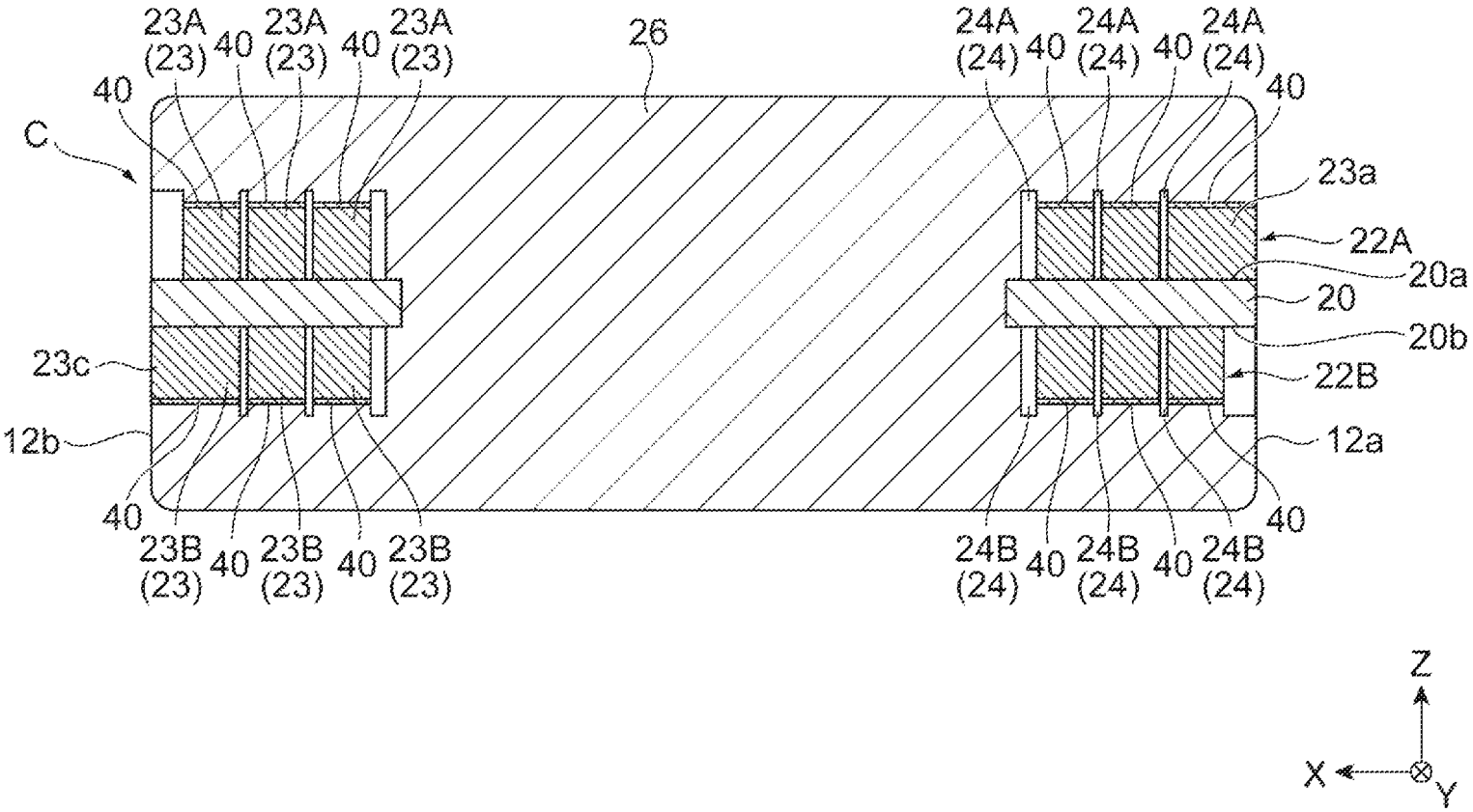
FIG. 3 is a cross-sectional view along line III-III in the coil component shown in FIG. 1.
Figure 4:
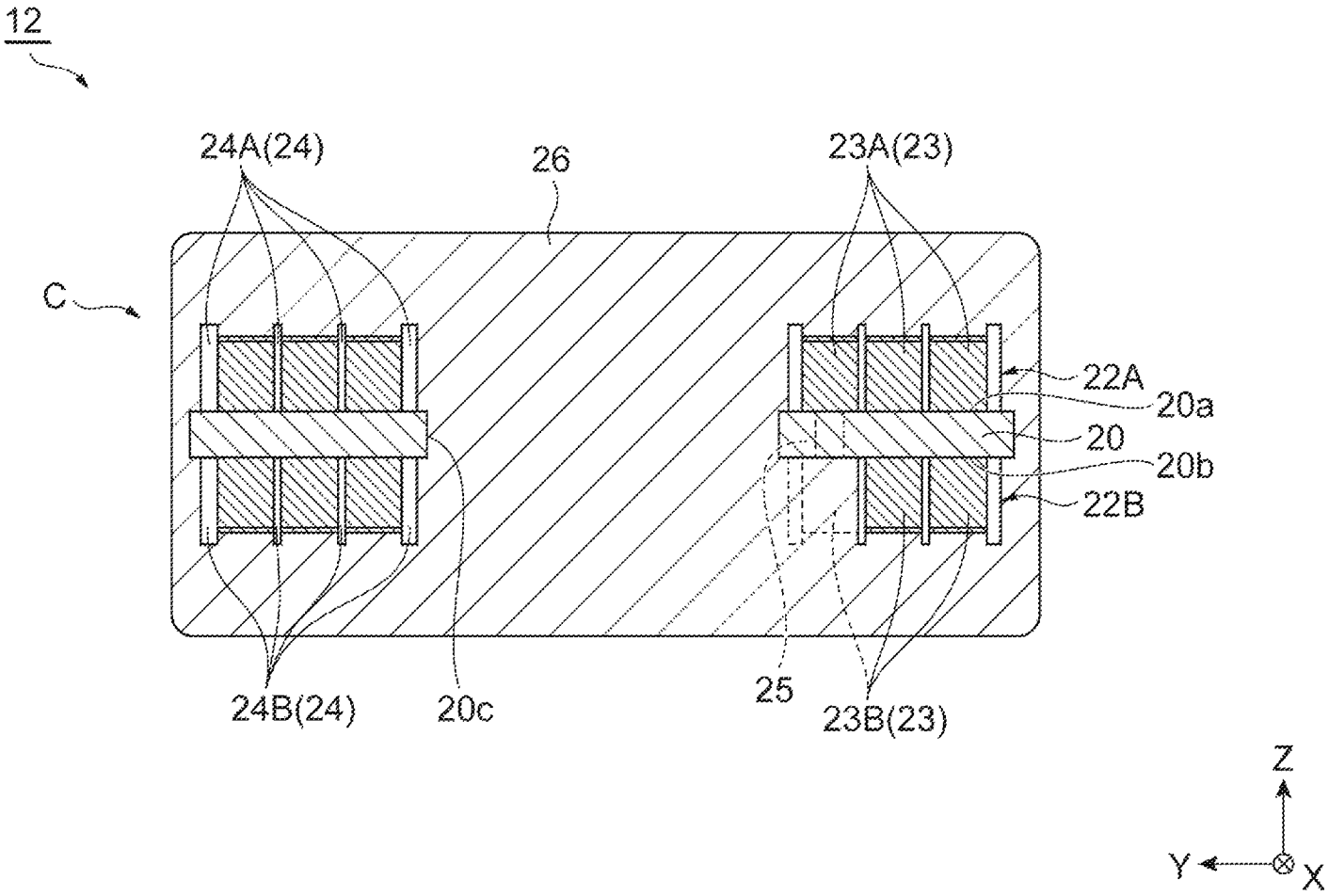
FIG. 4 is a cross-sectional view along line IV-IV in the coil component shown in FIG. 1.

In addition, as shown in FIGS. 3 and 4, each of the first coil portion 22A and the second coil portion 22B has a resin wall 24. In the resin walls 24, a resin wall 24A of the first coil portion 22A is positioned between lines and on the inner circumference and the outer circumference of the first conductor pattern 23A, and a resin wall 24B of the second coil portion 22B is positioned between lines and on the inner circumference and the outer circumference of the second conductor pattern 23B. In the present embodiment, the resin walls 24A and 24B positioned on the inner circumferences and the outer circumferences of the conductor patterns 23A and 23B are designed to be thicker than the resin walls 24A and 24B positioned between lines of the conductor patterns 23A and 23B.

The resin walls 24 are constituted of an insulating resin material. The resin walls 24 can be provided on the insulation substrate 20 before the conductor patterns 23 are formed. In this case, the conductor patterns 23 are subjected to plating growth between walls defined by the resin walls 24. That is, regions for forming the conductor patterns 23 are defined by the resin walls 24 provided on the insulation substrate 20. The resin walls 24 can be provided on the insulation substrate 20 after the conductor patterns 23 are formed. In this case, the resin walls 24 are provided in the conductor patterns 23 through filling, painting, or the like.

The height of resin wall 24 (that is, the height on the basis of the insulation substrate 20) is designed to be higher than the height of the conductor pattern 23. For this reason, compared to when the height of the resin wall 24 and the height of the conductor pattern 23 are the same, a creepage distance between conductor patterns 23 adjacent to each other with the resin wall 24 therebetween is extended. Accordingly, a situation in which a short circuit occurs between conductor patterns 23 adjacent to each other is curbed.

The magnetic body 26 integrally covers the insulation substrate 20 and the coil C. More specifically, the magnetic body 26 covers the insulation substrate 20 and the coil C in an up-down direction and covers the outer circumference of the insulation substrate 20 and the coil C. In addition, the magnetic body 26 fills the inside of the penetration hole 20*c* of the insulation substrate 20 and an inward region of the coil C.

The magnetic body 26 is constituted of a metal magnetic powder-containing resin. The metal magnetic powder-containing resin is a binding powdery substance in which a metal magnetic powdery substance is bound with a binder resin. For example, the metal magnetic powders of the metal magnetic powder-containing resin constituting the magnetic body 26 are constituted of an iron-nickel alloy (permalloy alloy), carbonyl iron, amorphous, a non-crystalline or crystalline FeSiCr-based alloy, or Sendust. For example, the binder resin is a thermosetting epoxy resin. In the present embodiment, a metal magnetic powdery substance content in the binding powdery substance is within a range of 80 to 92 vol % in percent by volume and is within a range of 95 to 99 wt % in percent by mass. From the viewpoint of magnetic characteristics, the metal magnetic powdery substance content in the binding powdery substance may be within a range of 85 to 92 vol % in percent by volume and may be within a range of 97 to 99 wt % in percent by mass. The magnetic powders of the metal magnetic powder-containing resin constituting the magnetic body 26 may be a powdery substance having an average particle size of one kind or may be a powder mix having an average particle size of a plurality of kinds. In the present embodiment, the magnetic powders of the metal magnetic powder-containing resin constituting the magnetic body 26 are a powder mix having average particle sizes of three kinds. When the magnetic powders of the metal magnetic powder-containing resin constituting the magnetic body 26 are in a powder mix, the kinds of the magnetic powders having different average particle sizes may be the same or may vary.

Figure 5:
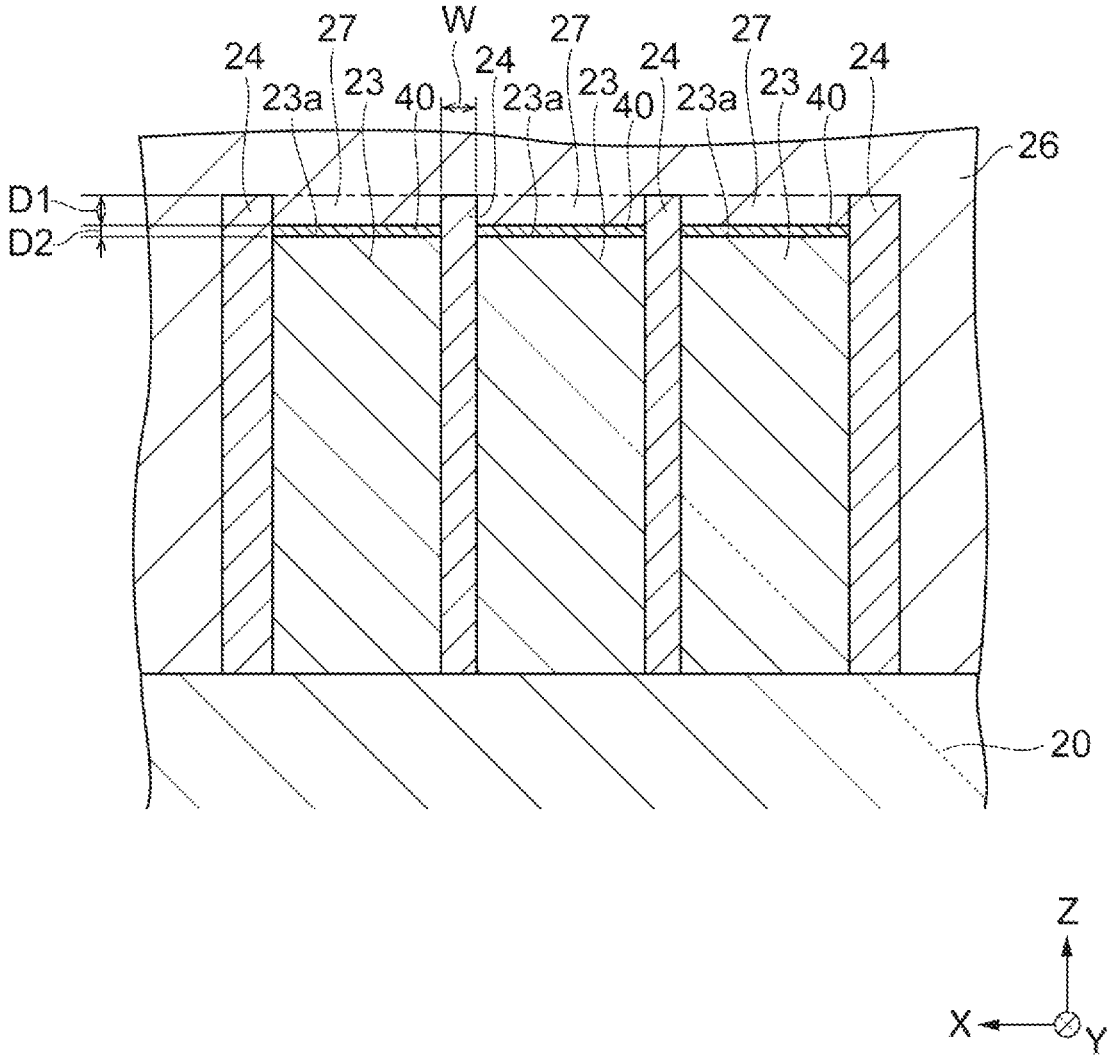
FIG. 5 is an enlarged view of a main part in the cross section shown in FIG. 4.

As shown in FIG. 5, the magnetic body 26 has an embedded portion 27 which enters a space between the resin walls 24. Since the height of the resin wall 24 is higher than the height of the conductor pattern 23, a step (recess) is generated between the resin wall 24 and the conductor pattern 23, and the embedded portion 27 enters the step. A thickness D1 of the embedded portion 27 can be stipulated as a length extending from a tip portion of the resin wall 24 toward the conductor pattern 23. For example, the thickness D1 of the embedded portion 27 is within a range of 1 μm to 50 μm (as an example, 20 μm).

Figure 6:
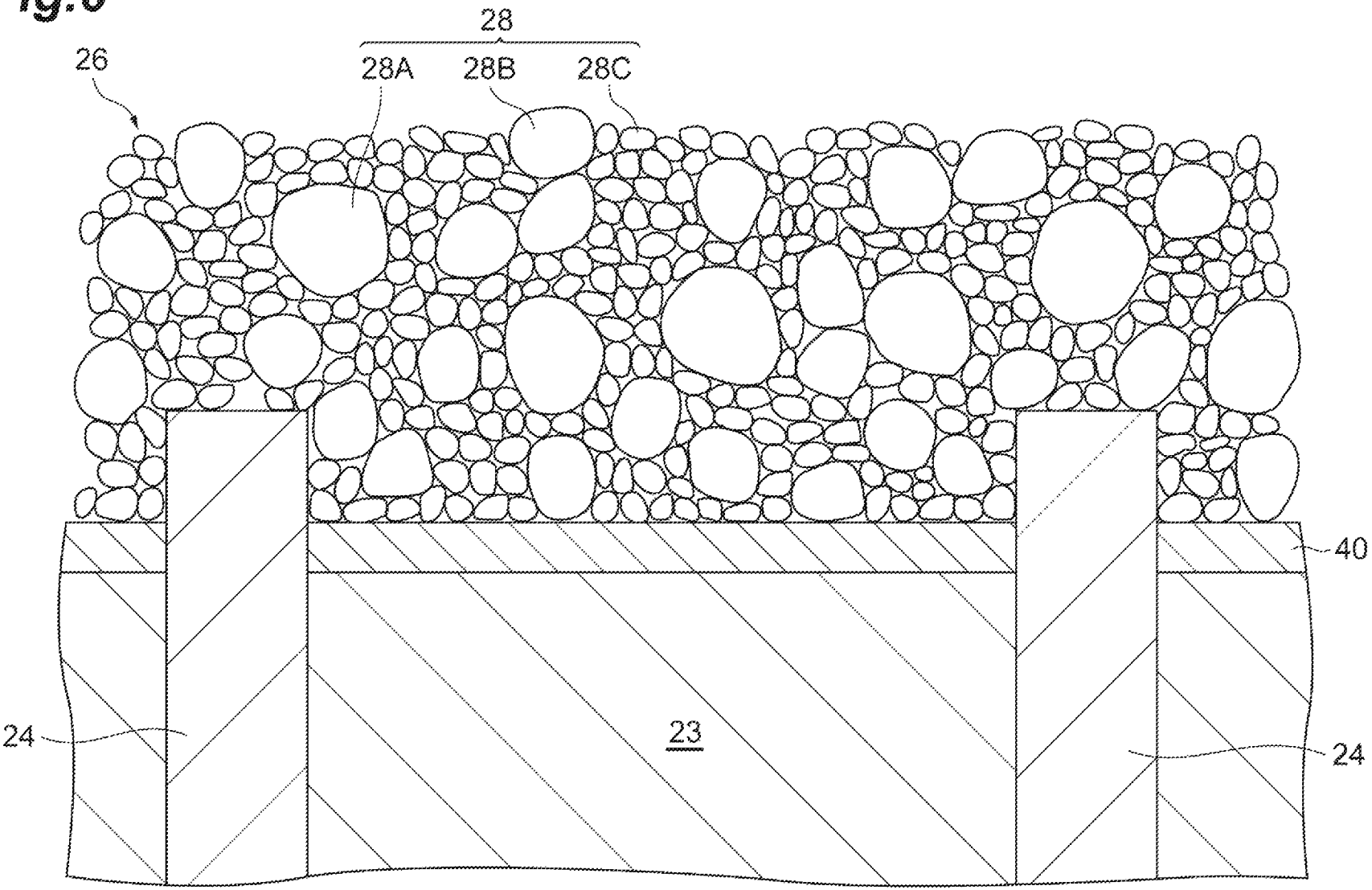
FIG. 6 is an enlarged view of a main part in the cross section shown in FIG. 5.

At this time, as shown in FIG. 6, magnetic powders 28 of a metal magnetic powder-containing resin constituting the magnetic body 26 enters the recess between the resin wall 24 and the conductor pattern 23. In the magnetic powders 28, the particle size of magnetic powders (large particle powders) 28A having the largest average particle size can be within a range of 15 to 30 μm, the particle size of magnetic powders (small particle powders) 28C having the smallest average particle size can be within a range of 0.3 to 1.5 μm, and magnetic powders (intermediate powders) 28B having an average particle size between the large particle powders and the small particle powders can be within a range of 3 to 10 μm. 100 parts by weight of a powder mix may include large particle powders within a range of 60 to 80 parts by weight, intermediate particle powders within a range of 10 to 20 parts by weight, and small particle powders within a range of 10 to 20 parts by weight. The average particle size of the magnetic powders 28 is stipulated by the particle size (d50, a so-called median size) at 50% of the integrated value in a particle size distribution and is obtained as follows. A scanning electron microscope (SEM) photograph of a cross section of the magnetic body 26 is captured. The captured SEM photograph is subjected to image processing using software, boundaries of the magnetic powders 28 are distinguished, and the area of the magnetic powders 28 is calculated. The particle size is calculated by converting the calculated area of the magnetic powders 28 into an equivalent circle diameter. For example, the particle sizes of 100 or more magnetic powders 28 are calculated, and a particle size distribution of these magnetic powders 28 is obtained. The particle size at 50% of the integrated value in the obtained particle size distribution is referred to as the average particle size d50. The particle shapes of the magnetic powders 28 are not particularly limited.

An insulation layer 40 is interposed between the embedded portion 27 of the magnetic body 26 and the conductor pattern 23. The insulation layer 40 is provided throughout the whole surface of an upper surface 23*a* of the conductor pattern 23 between resin walls 24 adjacent to each other. The insulation layer 40 is constituted of a resin such as an epoxy resin or a polyimide resin, for example. In the present embodiment, the insulation layer 40 is an electrodeposited layer formed by using an electrodeposition method. The insulation layer 40 has a uniform thickness D2. For example, the insulation layer 40 has a thickness within a range of 1 μm to 30 μm (as an example, 8 μm). In the present embodiment, the thickness D2 of the insulation layer 40 is designed to become thinner than a width W of an upper end of the resin wall 24. The thickness D2 of the insulation layer 40 can be designed to become thinner than the thickness D1 of the embedded portion 27 of the magnetic body 26.

In the coil component 10 described above, the insulation layer 40 covers the upper surface 23*a* of the conductor pattern 23. Accordingly, insulating properties between the conductor pattern 23 and the magnetic body 26 are enhanced, and insulating properties between the conductor patterns 23 are enhanced. In addition, in the coil component 10, the magnetic body 26 enters a space between the resin walls 24 such that the insulation layer 40 is covered. Therefore, a volume of the magnetic body 26 above the conductor pattern 23 is increased, and improvement of coil characteristics such as an inductance value is realized.

In addition, in the coil component 10, the thickness D2 of the insulation layer 40 is thinner than the width W of the upper end of the resin wall 24. The volume of the magnetic body 26 can be further increased, and the coil characteristics can be further improved by thinning the thickness D2 of the insulation layer 40. Meanwhile, a creepage distance between the conductor patterns 23 can be secured and short-circuiting between the conductor patterns 23 is curbed by thickening the width W of the upper end of the resin wall 24.

The present disclosure is not limited to the embodiment described above, and various forms can be adopted.

Figure 7:
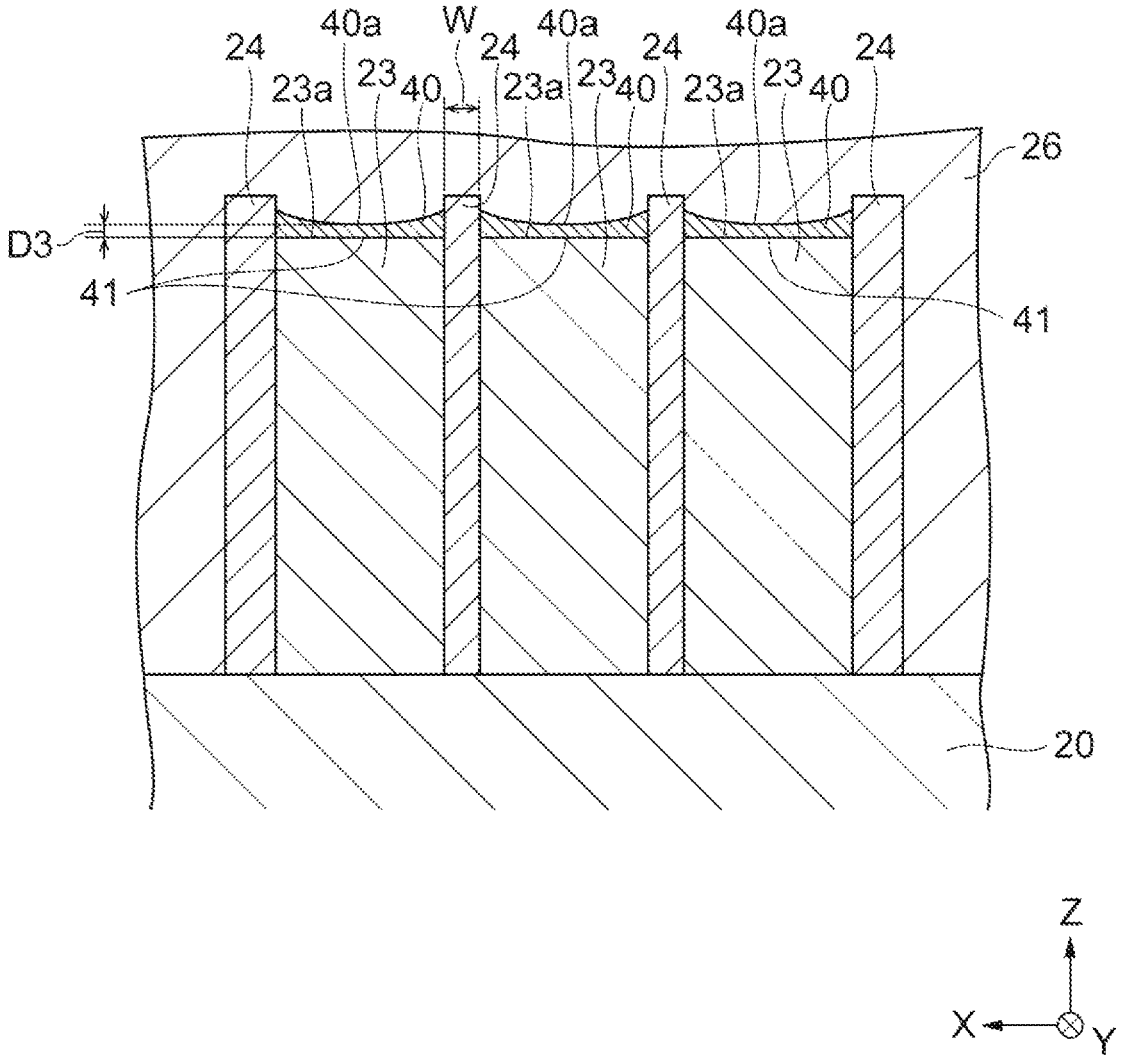
FIG. 7 is a view showing a coil component in a different form.
Figure 8:
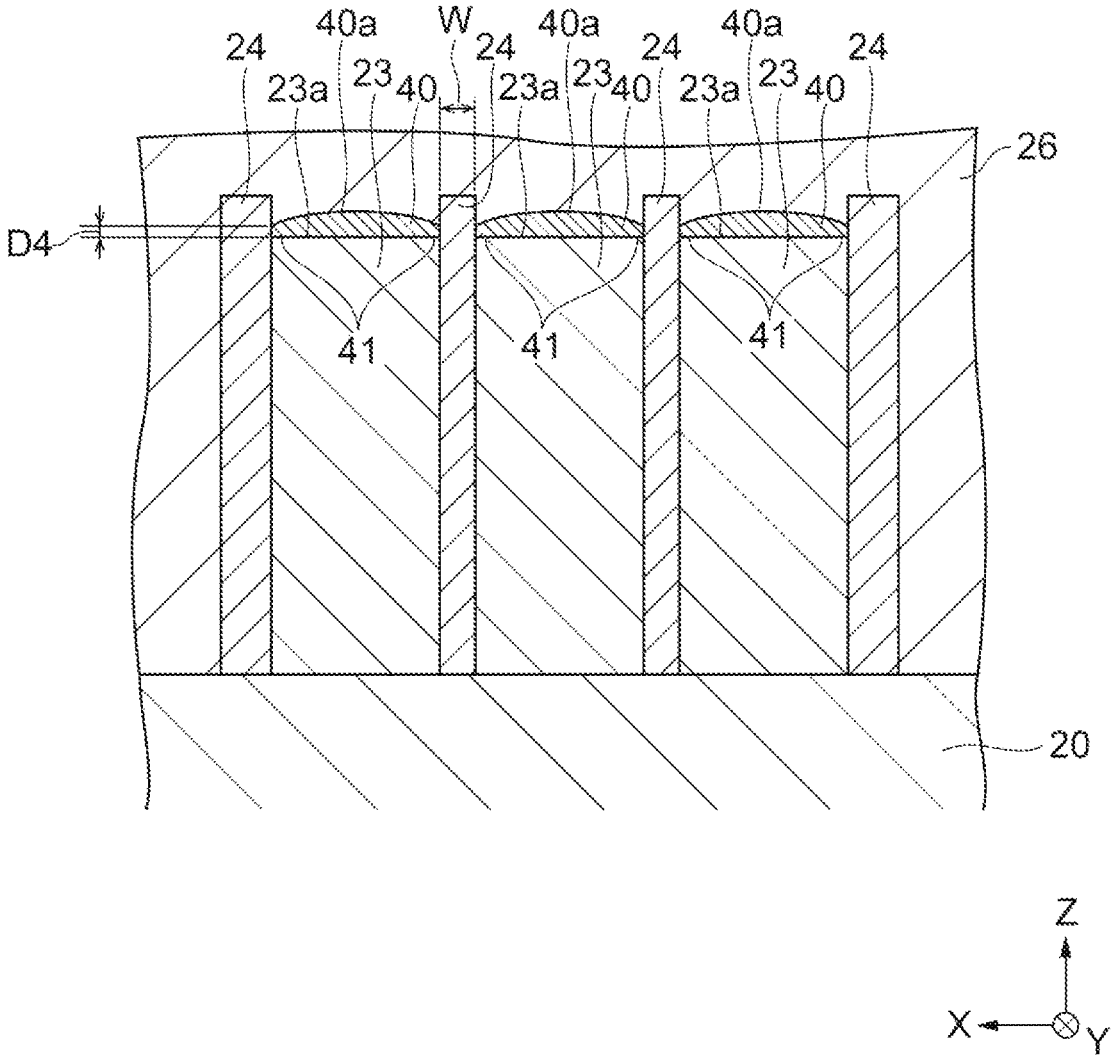
FIG. 8 is a view showing a coil component in a different form.

For example, the insulation layer 40 may have a form in which the thickness is not uniform as shown in FIGS. 7 and 8. The insulation layer 40 shown in FIG. 7 has a thinnest portion 41 which is the thinnest at an intermediate position of the resin wall 24 having the conductor pattern 23 interposed therebetween, and an upper surface 40*a* is curved in a concave shape. Since the insulation layer 40 shown in FIG. 7 has a thick part which comes into contact with the resin walls 24 on both sides having the conductor pattern 23 interposed therebetween, the rigidity of the resin walls 24 can be enhanced. Furthermore, compared to when the upper surface 40*a* is flat, the insulation layer 40 shown in FIG. 7 has an extended contact area with respect to the magnetic body 26. Therefore, an adhesive force with respect to the magnetic body 26 is also improved. The insulation layer 40 shown in FIG. 8 has the thinnest portion 41 which is the thinnest at a position close to the resin walls 24 having the conductor pattern 23 interposed therebetween, and the upper surface 40*a* is curved in a convex shape. Compared to when the upper surface 40*a* is flat, the insulation layer 40 shown in FIG. 8 has an extended contact area with respect to the magnetic body 26. Therefore, an adhesive force with respect to the magnetic body 26 is improved. An insulation layer having a non-uniform thickness can be formed by adjusting wettability (wettability with respect to a conductor pattern and a resin wall) of an insulating material when the insulation layer is formed, for example.

What is claimed is:

1. A coil component comprising: an insulation substrate; a coil having a flat coil pattern formed on at least one surface of the insulation substrate;

a resin wall provided on the insulation substrate, defining a region for forming the flat coil pattern, and having a height on the basis of the insulation substrate higher than a height of the flat coil pattern; an insulation layer covering an outer surface of the flat coil pattern between adjacent portions of the resin wall; and a magnetic body integrally covering the insulation substrate by extending into a space between the adjacent portions of the resin wall to enclose the insulation layer between the magnetic body, the adjacent portions of the resin wall and the coil.

2. The coil component according to claim 1,
wherein the insulation layer has a thinnest portion, a thickness in the thinnest portion in a thickness direction of the insulation substrate is the thinnest, and the thinnest portion is thinner than a width of an upper end of the resin wall.

3. The coil component according to claim 1,
wherein an upper surface of the insulation layer is curved in a concave shape.

4. The coil component according to claim 1,
wherein an upper surface of the insulation layer is curved in a convex shape.

5. The coil component according to claim 2,
wherein an upper surface of the insulation layer is curved in a concave shape.

6. The coil component according to claim 2,
wherein an upper surface of the insulation layer is curved in a convex shape.

* * * * *